US010149995B1

(12) United States Patent
Ashe

(10) Patent No.: US 10,149,995 B1
(45) Date of Patent: Dec. 11, 2018

(54) ARM EXERCISE APPARATUS INCLUDING GLOVES AND ATTACHED RESISTANCE BANDS

(71) Applicant: ARA Sports LLC, Virginia Beach, VA (US)

(72) Inventor: Allison Ashe, Virginia Beach, VA (US)

( * ) Notice: Subject to any disclaimer, the term of this patent is extended or adjusted under 35 U.S.C. 154(b) by 0 days.

(21) Appl. No.: 15/834,549

(22) Filed: Dec. 7, 2017

Related U.S. Application Data

(60) Provisional application No. 62/578,146, filed on Oct. 27, 2017.

(51) Int. Cl.
*A63B 21/04* (2006.01)
*A41D 19/00* (2006.01)
(Continued)

(52) U.S. Cl.
CPC ..... *A63B 21/0407* (2013.01); *A41D 19/0037* (2013.01); *A63B 21/00061* (2013.01);
(Continued)

(58) Field of Classification Search
CPC ..... A63B 21/02; A63B 21/04; A63B 21/0407; A63B 21/0442; A63B 21/055; A63B 21/0552; A63B 21/0555; A63B 21/0557; A63B 21/065; A63B 21/16; A63B 21/4003–21/4009; A63B 21/4017; A63B 21/4019; A63B 21/4021; A63B 21/4025; A63B 21/4035; A63B 21/4039; A63B 21/08; A63B 21/068; A63B 23/02; A63B 23/025; A63B 23/035; A63B 23/03508; A63B 23/03516; A63B 23/03533; A63B 23/03541; A63B 23/12; A63B 23/14; A63B 23/16; A63B 65/00; A63B 65/12;
(Continued)

(56) References Cited

U.S. PATENT DOCUMENTS 5,188,365 A * 2/1993 Picard ..... A63B 69/0059 473/212
5,203,754 A * 4/1993 Maclean ..... A63B 21/0004 482/121

(Continued)

OTHER PUBLICATIONS

TricepToner How to Assemble, https://www.youtube.com/watch?time_continue=2&v=8XVOwMYpFwo, Nov. 9, 2017 (accessed Feb. 19, 2018).

(Continued)

*Primary Examiner* — Nyca T Nguyen
(74) *Attorney, Agent, or Firm* — Greenspoon Marder LLP

(57) ABSTRACT

An arm exercise apparatus includes gloves and attached resistance bands that tone and firm the triceps area and reduce flabby arms by reducing fat. The disclosed exercise apparatus is comprised of an exercise glove with an arm band and resistance band that attaches to both the arm band and the glove, weighing less than 1 lb. together, along with a neck strap to secure the device. The disclosed apparatus or device can provide varying resistance strengths to work the triceps up to 35 lbs. and, in some embodiments up to 50 lbs., varying according to the resistance band used. The apparatus can be used in any location (e.g., while walking in a neighborhood, in the bathroom, kitchen, break room). The apparatus is compact and portable.

7 Claims, 6 Drawing Sheets

(51) Int. Cl.
*A63B 21/055* (2006.01)
*A63B 21/00* (2006.01)
*A63B 23/12* (2006.01)

(52) U.S. Cl.
CPC ..... *A63B 21/0414* (2013.01); *A63B 21/0442* (2013.01); *A63B 21/055* (2013.01); *A63B 21/0557* (2013.01); *A63B 21/4017* (2015.10); *A63B 21/4019* (2015.10); *A63B 21/4035* (2015.10); *A63B 23/12* (2013.01); *A41D 2300/32* (2013.01); *A41D 2600/10* (2013.01); *A63B 2209/10* (2013.01)

(58) Field of Classification Search
CPC ... A63B 65/125; A63B 23/125; A63B 23/127; A63B 69/0002; A63B 69/38; A63B 69/385; A63B 2069/0006; A63B 2069/0008; A63B 21/00047; A63B 21/00058; A63B 21/00061
See application file for complete search history.

(56) References Cited

U.S. PATENT DOCUMENTS 5,306,222 A * 4/1994 Wilkinson ..... A41D 13/0015 482/121
5,328,432 A * 7/1994 Gvoich ..... A63B 21/018 482/114
5,514,059 A * 5/1996 Romney ..... A63B 21/0004 482/121
5,518,480 A * 5/1996 Frappier ..... A63B 21/0004 482/124
5,647,827 A * 7/1997 Gutkowski ..... A63B 21/0004 482/122
5,681,248 A * 10/1997 Vani ..... A63B 21/0004 482/10
5,813,955 A * 9/1998 Gutkowski ..... A63B 21/0004 482/121
5,993,362 A * 11/1999 Ghobadi ..... A63B 21/0004 482/121
6,007,463 A * 12/1999 Wells ..... A63B 21/0004 482/122
6,099,446 A * 8/2000 Johnson ..... A63B 21/0004 482/124
6,287,241 B1 * 9/2001 Ellis ..... A63B 21/06 482/100
6,672,997 B1 * 1/2004 Winkler ..... A63B 21/0552 482/121
7,314,437 B2 * 1/2008 Frappier ..... A63B 21/00065 482/124
7,608,026 B1 * 10/2009 Nicassio ..... A63B 21/00185 24/265 BC
7,935,036 B2 * 5/2011 Haynes ..... A63B 21/4025 482/121
7,998,034 B1 * 8/2011 Cobo ..... A63B 69/0028 482/126
8,784,285 B1 * 7/2014 Lopez ..... A63B 21/0555 482/121
9,061,173 B1 * 6/2015 Felkel ..... A63B 21/0557
9,675,835 B1 * 6/2017 Abramovich ..... A63B 21/0555
9,914,012 B2 * 3/2018 Walter ..... A63B 22/02
2001/0007845 A1 * 7/2001 Afanasenko ..... A61F 5/01 482/124
2002/0187884 A1 * 12/2002 McGrath ..... A63B 21/0552 482/121
2003/0040408 A1 * 2/2003 Cooper, Sr. ..... A63B 69/0028 482/124
2005/0107222 A1 * 5/2005 Toven ..... A63B 69/0028 482/74
2007/0004571 A1 * 1/2007 Gonzalez ..... A63B 21/0004 482/124
2007/0135279 A1 * 6/2007 Purdy ..... A63B 21/0004 482/124
2008/0194390 A1 * 8/2008 Todd ..... A63B 21/00185 482/124
2012/0283077 A1 * 11/2012 Cranke ..... A63B 21/0442 482/124
2015/0065317 A1 * 3/2015 Washington ..... A63B 21/0442 482/124
2015/0251038 A1 * 9/2015 Bybee ..... A63B 21/0442 482/124
2016/0101309 A1 * 4/2016 Schreiber ..... A61F 5/0127 482/124
2017/0140664 A1 * 5/2017 Arnold ..... G09B 19/0038
2018/0056113 A1 * 3/2018 Burkinshaw ..... A63B 21/1636

OTHER PUBLICATIONS

TricepToner 30 Second Commercial, https://www.youtube.com/watch?v=UPOJPJAbNFg, Dec. 5, 2017 (accessed Feb. 19, 2018).
TricepToner 15 Second Commercial, https://www.youtube.com/watch?v=g1UKqt56ntM, Dec. 5, 2017 (accessed Feb. 19, 2018).
TricepToner How to Exercise, https://www.youtube.com/watch?v=L6BiWvURL3M, Nov. 9, 2017 (accessed Feb. 19, 2018).

* cited by examiner

ARM EXERCISE APPARATUS INCLUDING GLOVES AND ATTACHED RESISTANCE BANDS

CROSS REFERENCE TO RELATED APPLICATIONS

This patent application claims the benefit of U.S. Prov. Pat. App. No. 62/578,146 filed on Oct. 27, 2017, the entirety of which is hereby incorporated by reference.

BACKGROUND

Field of the Invention

This invention relates to the general field of exercise apparatuses, and more specifically toward an arm exercise apparatus including gloves and attached resistance bands that tones and firms the triceps area and reduces flabby arms by reducing fat. The disclosed exercise apparatus is comprised of an exercise glove with an arm band and resistance band that attaches to both the arm band and the glove, weighing less than 1 lb. together, along with a neck strap to secure the device. The disclosed apparatus or device can provide varying resistance strengths to work the triceps up to 35 lbs. and, in some embodiments up to 50 lbs., varying according to the resistance band used. The apparatus can be used in any location (e.g., while walking in a neighborhood, in the bathroom, kitchen, break room). The apparatus is compact and portable.

Other exercise devices require heavy free weights or actual exercise/weight machines to work out the triceps muscles. However, these are often expensive, cumbersome, and difficult to set up and operate. These machines and free weights are heavy and require a gym membership or a home gym with expensive equipment. These machines and weights are not portable or mobile.

Thus there has existed a long-felt need for an exercise apparatus that is compact, portable, tones and firms the triceps area and reduces flabby arms by reducing fat.

SUMMARY

The current invention provides just such a solution by having an arm exercise apparatus including gloves and attached resistance bands that tones and firms the triceps area and reduces flabby arms by reducing fat. The disclosed exercise apparatus is comprised of an exercise glove with an arm band and resistance band that attaches to both the arm band and the glove, weighing less than 1 lb. together, along with a neck strap to secure the device. The disclosed apparatus or device can provide varying resistance strengths to work the triceps up to 35 lbs. and, in some embodiments up to 50 lbs., varying according to the resistance band used. The apparatus can be used in any location (e.g., while walking in a neighborhood, in the bathroom, kitchen, break room). The apparatus is compact and portable.

It is an object of the current disclosure to provide an exercise apparatus for toning and firming the triceps muscles of a user.

It is another object of the current disclosure to provide an exercise apparatus for reducing fat within the arms of a user.

It is a further object of this disclosure to provide a method for toning and firming the triceps muscles of a user.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future. Furthermore, the use of plurals can also refer to the singular, including without limitation when a term refers to one or more of a particular item; likewise, the use of a singular term can also include the plural, unless the context dictates otherwise.

The presence of broadening words and phrases such as "one or more," "at least," "but not limited to" or other like phrases in some instances shall not be read to mean that the narrower case is intended or required in instances where such broadening phrases may be absent. Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

As used herein, "clip" shall refer to any of various devices that grip, clasp, hook, or otherwise be secured to a ring-like structure; "ring" shall refer to a band used to secure or attach two objects together, for example, a glove and a clip, and may have various shapes, such as circular, D-shaped, triangular, or square.

Embodiments of the current disclosure include an apparatus comprising a glove having a top side and a palm side, where the glove comprises a ring attached to the palm side of the glove; an armband having a ring attached thereto; and a resistance band having a first end and a second end, where the resistance band comprises an elastic material between the first end and the second end, where the resistance band further comprises a first clip secured to the first end and a second clip secured to the second end; where the first clip of the resistance band is secured to the ring of the glove, and where the second clip of the resistance band is secured to the ring of the armband. The glove further comprises a strap extending along the top side and palm side of the glove. The armband comprises a second ring, where the second ring is adjacent to the first ring. The apparatus further comprises a neckband having a first clip secured to a first end, where the first clip of the neckband is secured to the second ring of the armband. The ring of the glove is a "D" shaped ring. The elastic material of the resistance band has an equivalent weight resistance of between 15 and 25 pounds, inclusive.

Additional embodiments of the current disclosure include an apparatus comprising a first glove and a second glove each with a ring attached thereto; a first armband and a second armband each with a first ring and a second ring attached thereto; and a first resistance band and a second resistance band each having a first end and a second end, where each resistance band comprises an elastic material, where each resistance band comprises a first clip secured to the first end and a second clip secured to the second end; and a neckband having a first clip secured to a first end and a second clip secured to a second end; where the first clip of the first resistance band is secured to the ring of the first glove, where the second clip of the first resistance band is secured to the first ring of the first armband; where the first clip of the second resistance band is secured to the ring of the second glove, where the second clip of the second resistance band is secured to the first ring of the second armband; and where the first clip of the neckband is secured to the second ring of the first armband, and where the second clip of the neckband is secured to the second ring of the second armband. The first glove and the second glove each have a top side and a palm side, where the ring of the first glove is attached to the palm side of the first glove, and where the ring of the second glove is attached to the palm side of the second glove. The first glove further comprises a strap extending along the top side and palm side of the first glove, and wherein the second glove further comprises a strap extending along the top side and palm side of the second glove. The second ring of the first armband is adjacent to the first ring of the first armband, and where the second ring of the second armband is adjacent to the first ring of the second armband. The ring of the glove is a triangle shaped ring. The first ring and second ring of the first armband and the first ring and second ring of the second armband are each a "D" shaped ring. The elastic material of the first resistance band and the second resistance band each has an equivalent weight resistance of between 8 and 12 pounds, inclusive.

Further embodiments of the current disclosure include a method of exercising comprising the steps of: donning a first glove; donning a first armband; securing a first clip of a first resistance band to a ring of the first glove, where the ring of the first glove is attached to a palm side of the first glove; securing a second clip of the first resistance band to a first ring of the first armband; and extending the first glove away from the first armband. The method further comprises the steps of: donning a second glove; donning a second armband; securing a first clip of a second resistance band to a ring of the second glove, where the ring of the second glove is attached to a palm side of the second glove; securing a second clip of the second resistance band to a first ring of the second armband; and extending the second glove away from the second armband. The method further comprises the steps of: donning a neckband; securing a first clip of the neckband to a second ring of the first armband; and securing a second clip of the neckband to a second ring of the second armband. The first glove further comprises a strap extending along a top side and the palm side of the first glove, and wherein the second glove further comprises a strap extending along a top side and palm side of the second glove. The second ring of the first armband is adjacent to the first ring of the first armband, and where the second ring of the second armband is adjacent to the first ring of the second armband. The ring of the first glove is a square shaped ring, and wherein the ring of the second glove is a square shaped ring. The elastic material of the first resistance band and the second resistance band each has an equivalent weight resistance of between 25-35 pounds, inclusive.

There has thus been outlined, rather broadly, the more important features of the current disclosure in order that the detailed description thereof may be better understood, and in order that the present contribution to the art may be better appreciated. There are additional features of the disclosure that will be described hereinafter and which will also form the subject matter of the claims appended hereto. The features listed herein and other features, aspects and advantages of the present disclosure will become better understood with reference to the following description and appended claims.

BRIEF DESCRIPTION OF THE FIGURES

The accompanying drawings, which are incorporated in and form a part of this specification, illustrate embodiments of the current disclosure and together with the description, serve to explain the principles of this invention.

DETAILED DESCRIPTION

Figure 1:
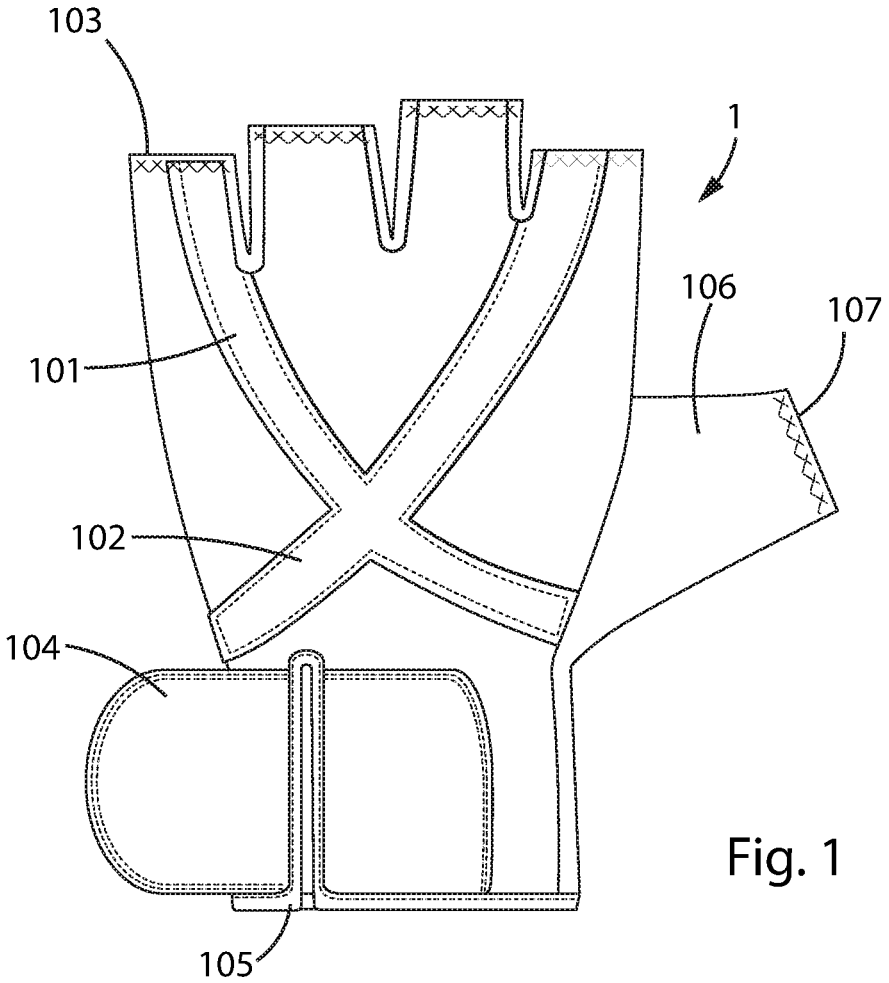
FIG. 1 is a top view of a glove according to selected embodiments of the current disclosure.

Many aspects of the current disclosure can be better understood with the references made to the drawings below. The components in the drawings are not necessarily drawn to scale. Instead, emphasis is placed upon clearly illustrating the components of the present disclosure. Moreover, like reference numerals designate corresponding parts through the several views in the drawings.

The apparatus as disclosed herein may be used to work out all three heads of the triceps muscle and tones the arm, thus getting rid of arm flabbiness and toning and firming the muscle.

The disclosed apparatus differs from what currently exists. Most other exercise equipment for the triceps requires heavy free weights or machines. These machines and free weights are heavy and require a gym membership or a home gym with expensive equipment. These machines and weights are not portable or mobile.

This exercise device is comprised of an exercise glove with an attached arm band and resistance band, all together weighing less than 1 lb. Even with its light weight and small size, the apparatus disclosed herein can provide varying resistance strengths to work out the triceps. In certain embodiments, the equivalent workout weight is up to 50 lbs. To stabilize the placement of the resistance band, a neck strap or band is secured to the arm band.

An exercise glove with at least one metal clip or D-ring is worn on each hand. A neoprene (or similar material) arm band with at least one metal clip or D-ring is worn on each upper arm. In one embodiment, the D-rings are made of plastic or another material capable of bearing the device's resistance load. A rubber resistance band has at least one clip on either end. One resistance band clip is attached to the metal clip or D-ring on the glove while the other resistance band clip attaches to the arm band clip or D-ring. As the arm straightens and bends to and from 90 degrees, the resistance band stretches and relaxes. Each time the arm straightens, the device works out the three heads of the triceps muscle.

In this way, the exercise device accomplishes a complete triceps muscle exercise by wearing a simple and comfortable neoprene-type fabric fingerless glove and an accompanying upper arm band with attached resistance bands that isolates and works out the three heads of the triceps muscle, all through the simple act of straightening and bending the arm in a repeated manner to tone, shape and strengthen the triceps muscles. In one embodiment, another material is used for the gloves that is capable of bearing the device's resistance load. In one embodiment, full gloves are used or full gloves with finger holds. In another embodiment, straps wrapped around the hand or wrist with attachments to secure the D-rings are used.

In one embodiment, the device is made from a neoprene (or similar) type fabric fingerless glove that is secured/adjusted with its hook and loop fastener (such as Velcro®) wrist strap. On the anterior portion of the wrist strap, at least one metal D-ring is securely sewn in. The exercise device is also comprised of an upper arm band, which can be made of a neoprene or neoprene-like material. The upper arm band is positioned at the top of the arm above the bicep area/just below the shoulder and is secured with an adjustable Velcro strap. In one embodiment, the upper arm band is secured by a clasp, clip, or other fastener. In one embodiment, a neck strap, shown in FIG. 6, holds two upper arm bands in place by clipping each end of the neck strap to the upper arm band.

In one embodiment, at least one D-ring is securely sewn to an anterior portion of the glove, this D-ring. One end of the resistance band 5 attaches to the exercise glove's D-ring and the other end of the resistance band attaches to the at least one of the arm band's D-rings. When the arm band is attached to the glove's D-ring, the resistance band extends from the anterior portion of the wrist proximally towards the antecubital area (crease of the elbow) and then continues to extend proximally towards the upper part of the bicep area, where the resistance band attaches to the upper arm band's at least one "D" ring. This resistance band at rest/relaxation has the resting arm at 90 degrees (the arm is an L shape). While the arm is being extended (straightened out), the resistance band is engaged. Variable sizes and strengths of resistance bands can be used with the glove and arm band. In one embodiment, each resistance bands has a clip on either end to attach to the "D" rings on both the glove and arm band.

The resistance band requires a person to exert force against the resistance band to straighten the arm, thus requiring the person's triceps muscles to fully engage. The arm is then bent back to its resting position (L shaped). The process of bending the elbow (rest) and extending or straightening the arm (exerting force against the resistance band) is repeated over and over to engage and work the triceps repeatedly each time the arm straightens. The exercise device is the first of its kind to provide active resistance to work the triceps muscles without the need for free weights or machines with cables or bulky wires. It is a portable device that can be worn on bare skin or over clothing. The resistance band allows a significant if not nearly constant resistance over the full range of motion, which forces the person to use all muscle groups (all three heads of the triceps muscle) while building strength. If done as an exercise activity and worn for ten to fifteen minutes during normal daily activity, the triceps muscles are repeatedly challenged and conditioned.

In one embodiment, the device is comprised of two gloves (one for the right hand and one for the left hand) so that both right and left arm triceps muscles can work simultaneously. Unlike conventional triceps exercises that require dumbbells, triceps dips, or overhead bars to work out the triceps muscles, the exercise device allows full isolation of the triceps while wearing simple and comfortable gloves and arm bands, each glove being connected to an arm band by a resistance band. This negates the need for weights or bars.

In one embodiment, the exercise device comes in several sizes to accommodate both women and men, and to accommodate different sized hands and upper arms. The arm bands can be tightened as necessary with the hook and loop fastener bands to ensure a snug fit. Sizing varies. In one embodiment, gloves and arm bands are sized S, M, and L.

In another embodiment, the exercise device comes in one universal size to accommodate both women and men, and to accommodate different sized hands and upper arms.

In one embodiment, the resistance bands are color coded by resistance level. For example, green may be a light resistance of 8-12 lbs., red may be a medium resistance, 15-25 lbs., and black can be maximum resistance, 25-35 lbs. Different bands and combinations of bands can be clipped into the glove and arm band to accommodate different strengths and fitness levels. The ultimate goal of the exercise device is to tone, shape and strengthen the triceps muscles to give definition and a nice lean look along with helping to reduce underarm fat.

In another embodiment, the glove's D-ring is changed to a clip or some other fastening mechanism. In another embodiment, the arm band's D-rings are changed to clips or some other fastening mechanism. In another embodiment, the clips on the resistance band are changed to b-rings. In another embodiment, another fastening mechanism is used to replace both the clips and d-rings on the arm band, glove, and resistance band.

FIG. 1 is a top view of a glove according to selected embodiments of the current disclosure. Glove 1 (in this figure, a left handed glove) includes a thumb section 106 with a thumb opening 107. A securing strap 104 restricts movement of a slit 105 in a wrist portion of the glove. Glove 1 also includes finger sections 103. Straps 101, 102 travel and cross over a back portion of the glove 1 and extend onto the palm of the glove 1, as shown in FIG. 2.

Figure 2:
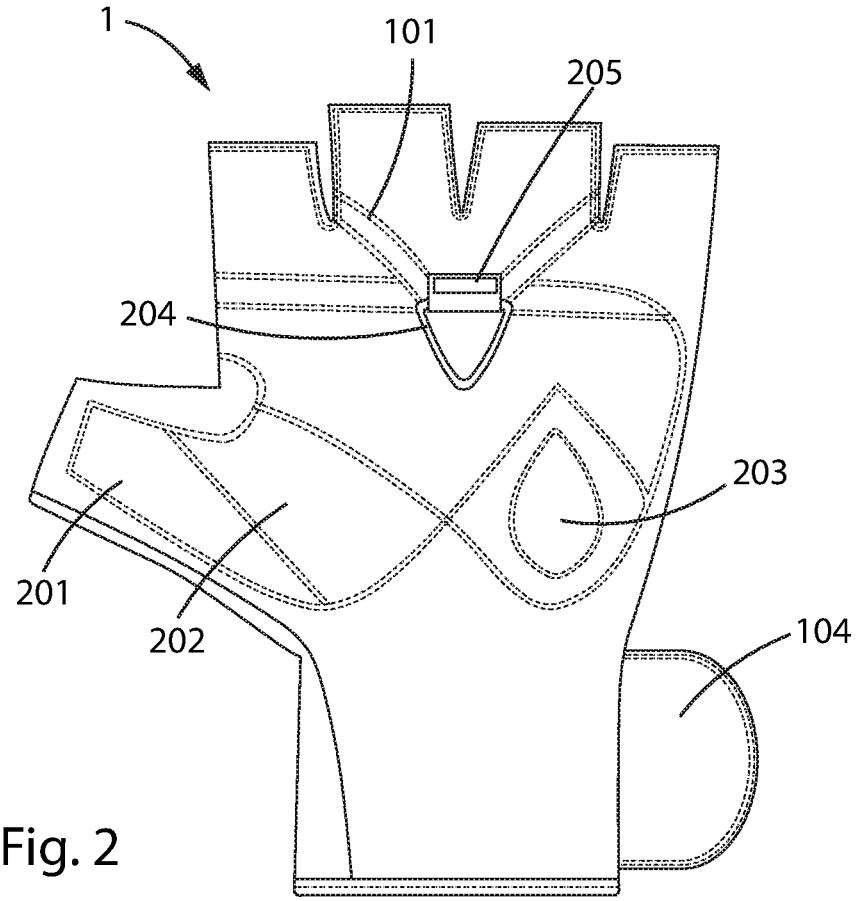
FIG. 2 is a palm side view of the glove in FIG. 1, according to selected embodiments of the current disclosure.

FIG. 2 is a palm side view of the glove in FIG. 1, according to selected embodiments of the current disclosure. Strap 101 extends from the top of the glove on to the palm side, and terminates at a ring 204 secured to the palm side of the glove 1 by sewn material 205. Various patterns 201, 202, 203 may be sewn into the palm portion of the glove 1, which may be used to secure padding thereto or therein. In one embodiment, the palm of the glove is padded. In another embodiment, the palm of the glove is not padded.

Figure 3:
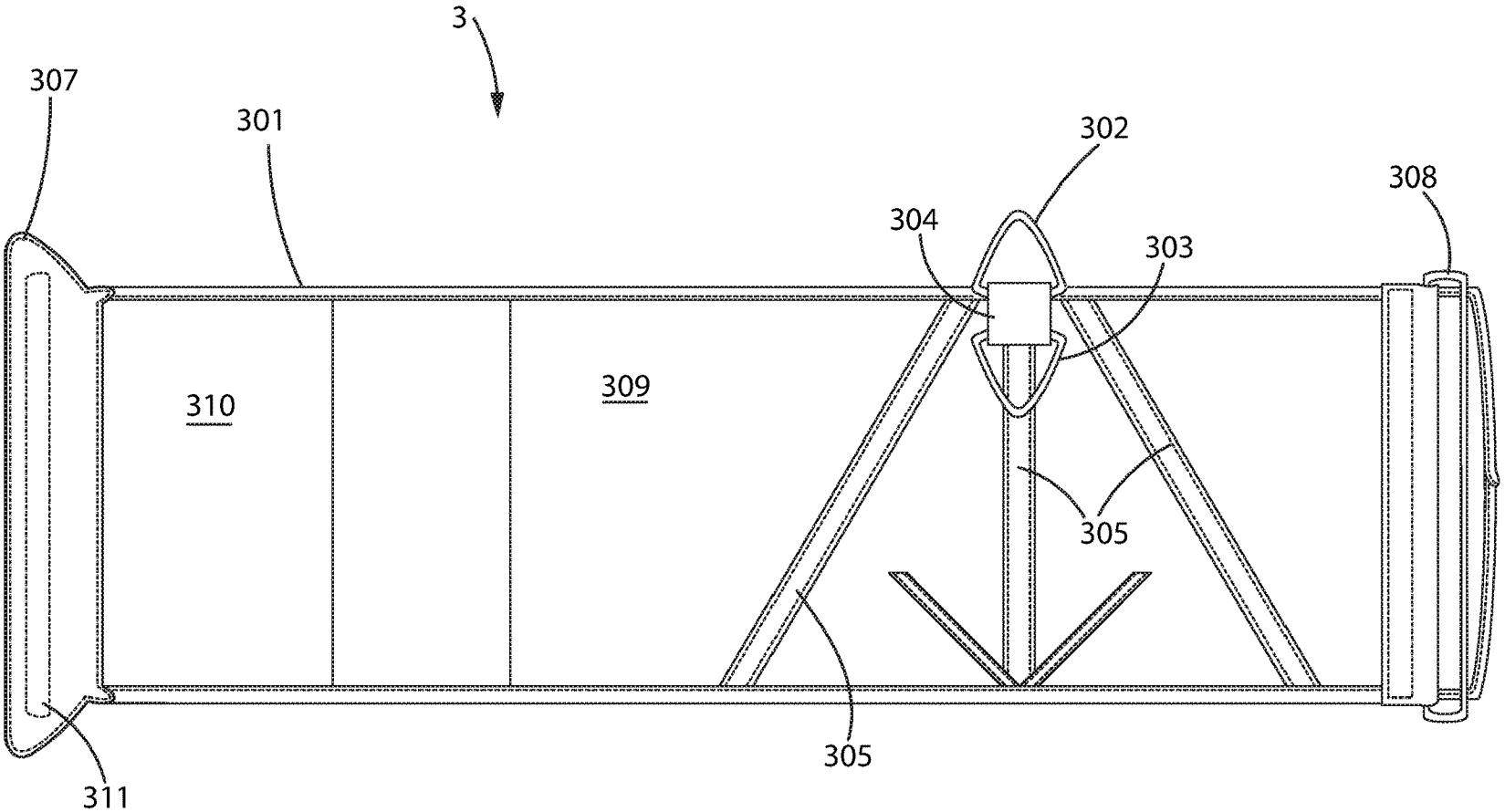
FIG. 3 is a top view of an armband according to selected embodiments of the current disclosure.

FIG. 3 is a top view of an armband according to selected embodiments of the current disclosure. Armband 3 has rings 302, 303 secured to the armband 3 by sewn material 304. Straps 305 add stiffness to the armband. A length 301 of the armband 3 includes hook portion 310 and loop portion 309 mating fasteners that secure to one another when the end 307 of the armband extends through ring 308 on the opposing end. End 307 may include a metal bar 311 for added stiffness and support.

To secure or don the armband 3 to the arm of a user, the armband 3 is placed around the arm of the user such that the rings 302,303 are facing outward. The end 307 is inserted through ring 308 and then pulled back on itself until hook portion 310 mates with loop portion 309.

Figure 4:
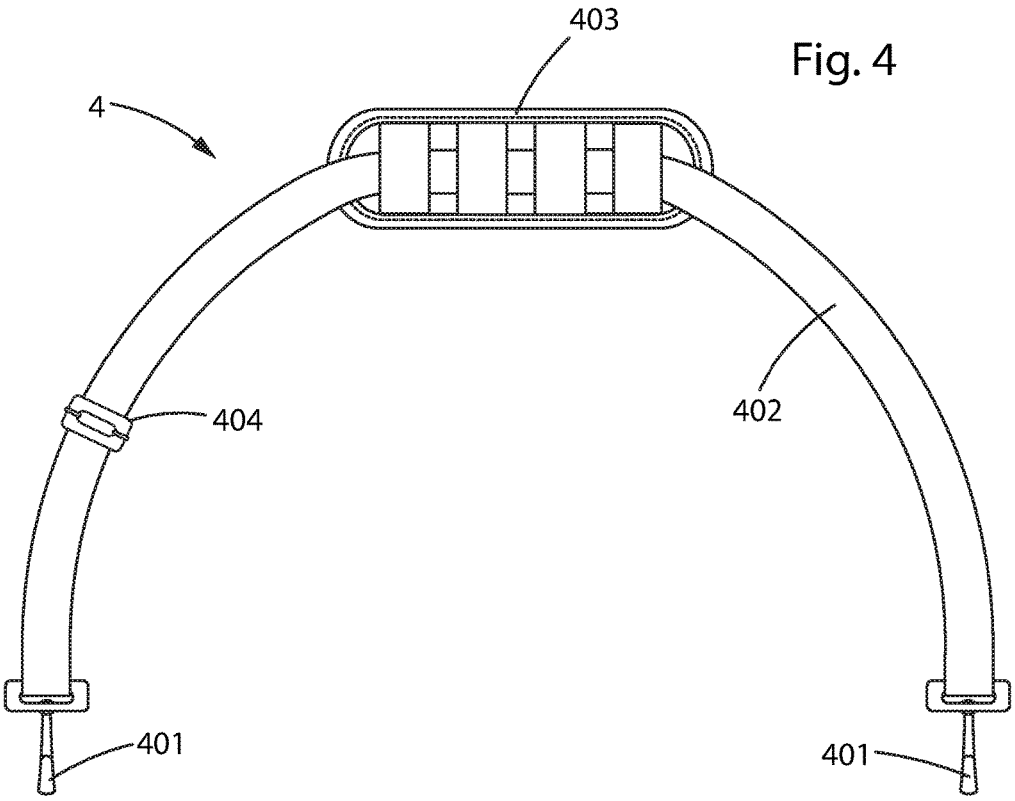
FIG. 4 is a stop view of a neckband according to selected embodiments of the current disclosure.

FIG. 4 is a top view of a neckband according to selected embodiments of the current disclosure. Neckband 4 includes a strap 402 with a padded portion 403. The strap's 402 length is adjusted by a cinch 404. Each end of the strap 402 includes clips 401.

Figure 5:
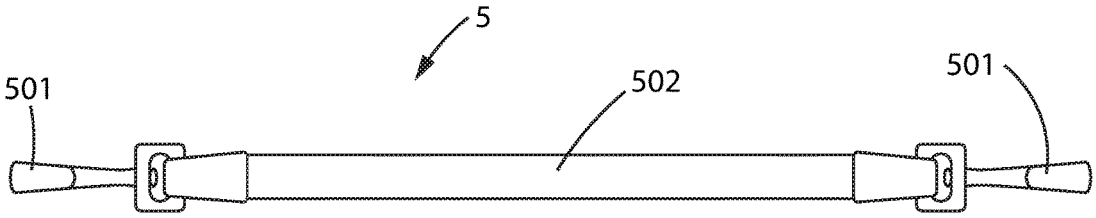
FIG. 5 is a top view of a resistance band according to selected embodiments of the current disclosure.

FIG. 5 is a top view of a resistance band according to selected embodiments of the current disclosure. Resistance band 5 has an elastic portion 502 with clips 501 secured to each end.

Figure 6:
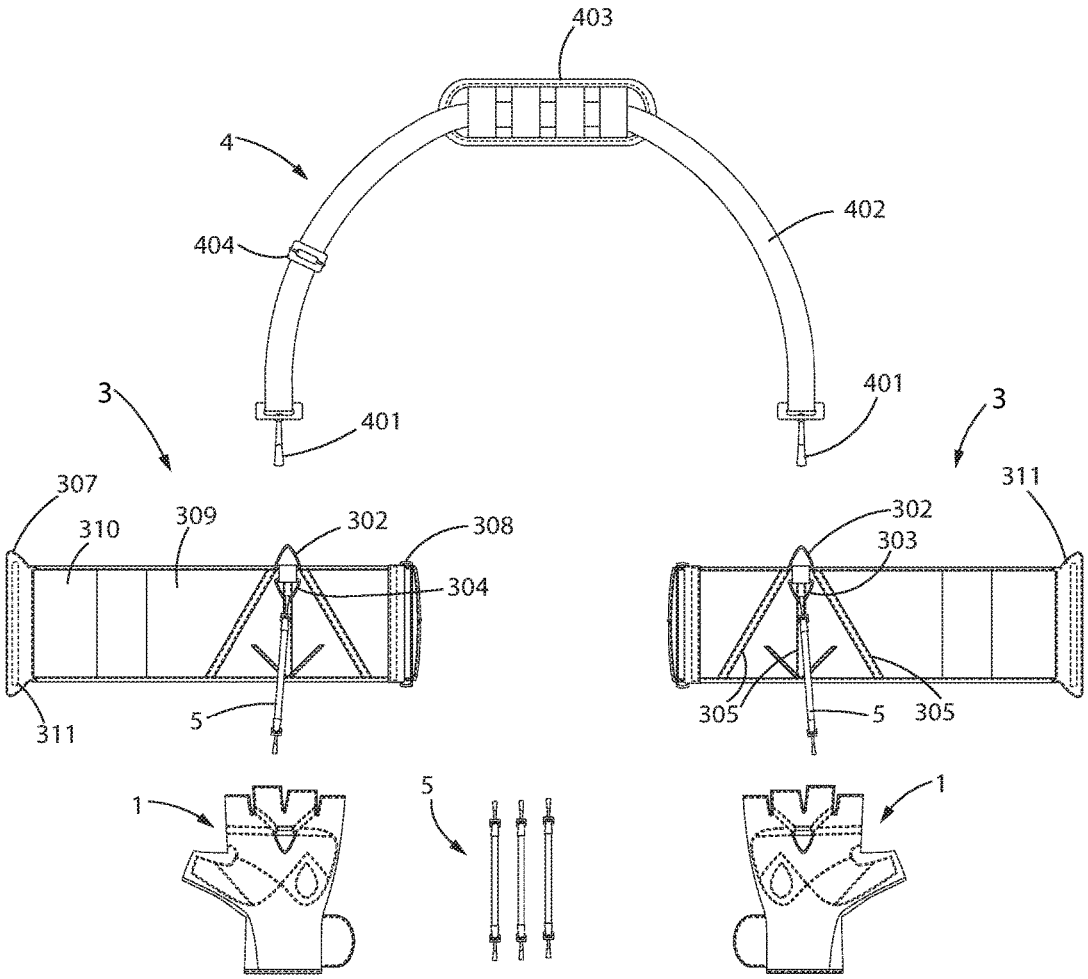
FIG. 6 is a top view of multiple elements of a glove set according to selected embodiments of the current disclosure.

FIG. 6 is a top view of an exercise apparatus including a glove set according to selected embodiments of the current disclosure. A user wears a glove 1 on each hand. An armband 3 is secured to each arm. A first resistance band 5 is secured to both left armband 3 and left glove 1 while a second resistance band 5 is secured to both right armband 3 and right glove 1. More specifically, clips 501 on each end of the resistance band 5 are used to secure the resistance band 5 to the ring 204 of glove 1 and ring 304 of armband 3, respectively. A neckband 4 is placed around the neck of a user such that the padded portion 403 rests on or about the back of the neck of the user. The clips 401 on each end of the neck strap 4 are secured to the rings 302 of the respective armbands 3. One skilled in the art should appreciate that the order in which the user dons the glove, armband and neck strap as well the order in which the resistance bands are secured to the glove and armbands may be varied without departing from the scope of the current disclosure.

A fingerless neoprene or similar type material glove 1 would be made including at least one metal D ring 204. A neoprene or similar material armband 3 with at least one metal D ring 303 (with hook and loop fastener straps for tightening) would also be manufactured. In one embodiment, three different strength resistance bands 5 are made with metal clips 501 on each end of the resistance band 502 that attach to the glove's 1 D-ring 204 and the arm band's at least one D-Ring 303. Additionally, the resistance bands may have different lengths and strengths to provide appropriate resistances for individual user's needs.

Fingerless glove 1 and armband 3 can be made of neoprene, but may also be made of other materials, either exclusively or in conjunction with neoprene. Resistance bands 5 (elastic) can be different strengths with clips 501 on either end to attach to "D" rings that are sewn into the glove 1 and arm band 3.

Different materials can be used to make the glove 1 or arm band 3. In one embodiment, the resistance bands can made of rubber. In other embodiments, the resistance bands 5 can be comprised of any type of elastic resistant material. The metal D rings and clips could be made of a different type of material (plastic, others). Instead of hook and loop fasteners, other functionally similar fasteners could be used. Likewise, while certain embodiments disclosed herein provide for D-rings sewn into the glove, other forms of attaching or securing the D-rings to the glove are possible, including adhesives, without departing from the scope of the current disclosure. Hook and loop fasteners, such as Velcro® brand fasteners may be replaced by other means of securing the specific elements to a user, such as magnetic fasteners, elastic bands, clips, clasps, and snaps.

Figure 7:
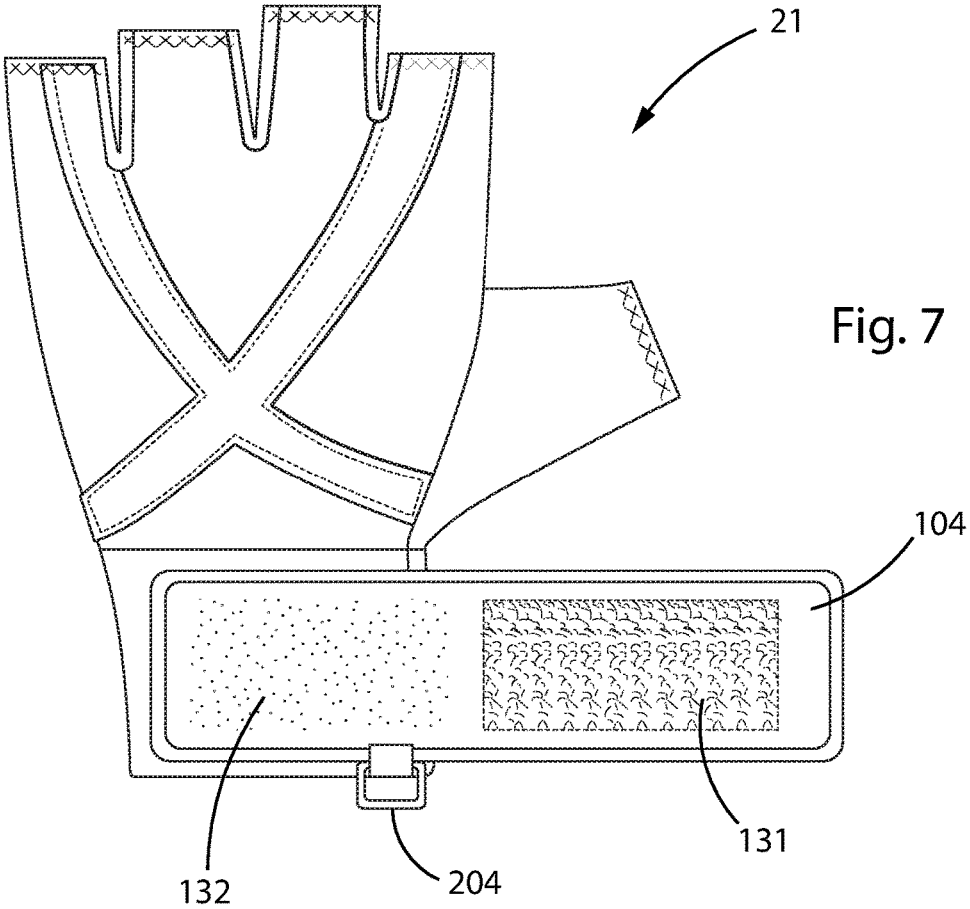
FIG. 7 is a top view of a glove according to selected embodiments of the current disclosure.

FIG. 7 is a top view of a glove according to selected embodiments of the current disclosure. Glove 21 includes a strap 104 that has a first hook and loop portion 131 that mates with a second hook and loop portion 132 for assisting in securing the glove 21 to the hand of a user. Ring 204 is secured at or near the wrist portion of the glove 21. In this particular view, the ring 204 is shown below the strap 104.

Figure 8:
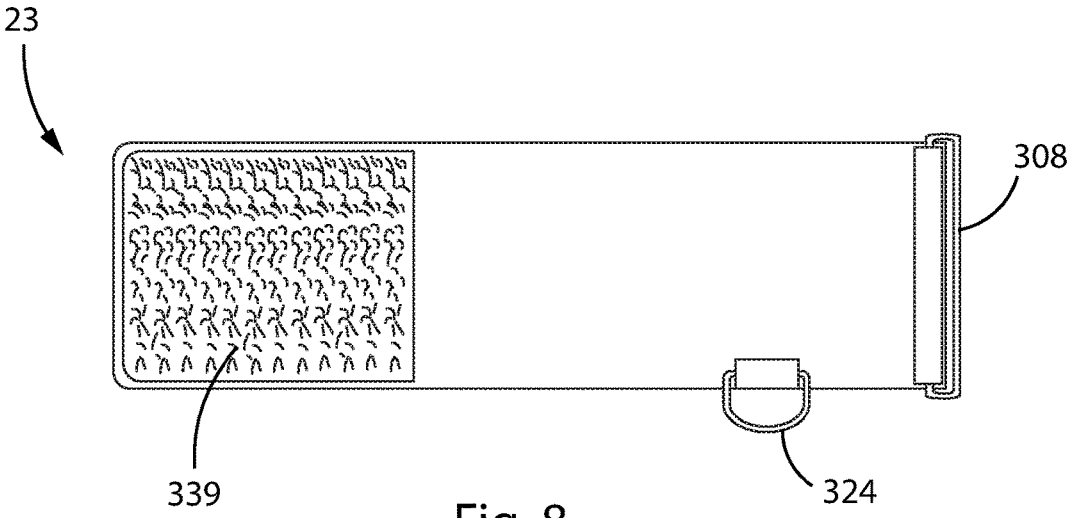
FIG. 8 is a top view of an armband according to selected embodiments of the current disclosure.

FIG. 8 is a top view of an armband according to selected embodiments of the current disclosure. Armband 23 includes a single ring 324 that is used to secure both the resistance band and neck strap thereto. The armband 23 also includes a hook and loop fastener portion 339 that extends through ring 308 for securing the armband 23 to the user.

Exemplary embodiments disclosed herein teach the use of D-rings to which clips may be attached. Nonetheless, alternative embodiments of the current disclosure provide for a triangular shaped ring or other shaped ring that provides for an appropriate looped structure for attaching a clip of a resistance band thereto. Likewise, the rings may be made from materials other than metal, such as plastic or carbon fiber.

Moreover, exemplary embodiments disclosed herein provide for gloves that are fingerless or are without fingertips. Alternative embodiments provide for gloves with fingers that are completely enclosed. Further embodiments provide for finger holes that are less than five, wherein multiple fingers may extend through a single opening. These embodiments may include gloves with or without padding in accordance with various configurations.

Other embodiments of the current disclosure include a wrist strap in place of a full glove. In such embodiments, an anterior portion of the wrist strap includes a ring to which a clip of a resistance band may be attached.

In particular embodiments, the gloves and armbands use triangle shaped rings, which may provide for better distribution of forces to the gloves and armbands, respectively. The triangular shaped rings distribute the forces from the resistance band more evenly to the attachment points to the gloves and armbands, thereby reducing the chance of failure at stress points of attachments.

While various embodiments of the present disclosure have been described above, it should be understood that they have been presented by way of example only, and not of limitation. Likewise, the various diagrams may depict an example architectural or other configuration for the invention, which is provided to aid in understanding the features and functionality that can be included in the invention. The invention is not restricted to the illustrated example architectures or configurations, but the desired features can be implemented using a variety of alternative architectures and configurations.

Indeed, it will be apparent to one of skill in the art how alternative functional configurations can be carried out to implement the desired features of the present invention. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

What I claim is:

1. An apparatus comprising:

a first glove and a second glove each with a ring attached thereto;

a first armband and a second armband each with a first ring and a second ring attached thereto; and a first resistance band and a second resistance band each having a first end and a second end, where each resistance band comprises an elastic material, where each resistance band comprises a first clip secured to the first end and a second clip secured to the second end; and a neckband having a first clip secured to a first end and a second clip secured to a second end;

where the first clip of the first resistance band is secured to the ring of the first glove, where the second clip of the first resistance band is secured to the first ring of the first armband;

where the first clip of the second resistance band is secured to the ring of the second glove, where the second clip of the second resistance band is secured to the first ring of the second armband; and where the first clip of the neckband is secured to the second ring of the first armband, and where the second clip of the neckband is secured to the second ring of the second armband;

where the first glove and the second glove each have a palm portion, where the ring of the first glove is attached to the palm portion of the first glove, and where the ring of the second glove is attached to the palm portion of the second glove whereby the apparatus, when in use, exercises all three heads of a user's triceps muscle.

2. The apparatus of claim 1, wherein the ring of the first glove is directly attached to the palm portion of the first glove, and wherein the ring of the second glove is directly attached to the palm portion of the second glove.

3. The apparatus of claim 2, wherein the first glove further comprises a strap extending along the top side and palm portion of the first glove said strap terminating at the location of the ring attached to the palm portion of the first glove, and wherein the second glove further comprises a strap extending along the top side and palm portion of the second glove said strap terminating at the location of the ring attached to the palm portion of the second glove.

4. The apparatus of claim 1, where the second ring of the first armband is adjacent to the first ring of the first armband, and where the second ring of the second armband is adjacent to the first ring of the second armband.

5. The apparatus of claim 1, wherein the ring of the first glove is a triangular shaped ring, and wherein the ring of the second glove is a triangular shaped ring.

6. The apparatus of claim 1, wherein the first ring and second ring of the first armband and the first ring and second ring of the second armband are each a triangular shaped ring.

7. The apparatus of claim 1, wherein the elastic material of the first resistance band and the second resistance band each has an equivalent weight resistance of between 8 and 35 pounds, inclusive.

* * * * *